United States Patent [19]

Lacy

[11] Patent Number: 4,523,549

[45] Date of Patent: Jun. 18, 1985

[54] INTERNAL COMBUSTION ENGINE

[76] Inventor: James W. Lacy, Rte. 3, Box 436, Sanford, Fla. 32771

[21] Appl. No.: 591,800

[22] Filed: Mar. 21, 1984

[51] Int. Cl.[3] ..... F02B 75/26

[52] U.S. Cl. ..... 123/58 BC

[58] Field of Search ..... 123/58 R, 58 B, 58 BC, 123/58 BB, 58 BA, 193 C, 193 P

[56] References Cited

U.S. PATENT DOCUMENTS

| | | | |
|---|---|---|---|
| 1,808,664 | 6/1931 | Koschka | 123/58 BC |
| 2,229,246 | 1/1941 | Istad | 123/51 BA |
| 4,068,645 | 1/1978 | Jenkinson | 123/193 CH |
| 4,092,967 | 6/1978 | Haslett | 123/193 P |

*Primary Examiner*—Craig R. Feinberg

*Attorney, Agent, or Firm*—William M. Hobby, III

[57] ABSTRACT

An internal combustion engine is disclosed with a pair of opposed pistons disposed inside a cylinder bore in a block. The pistons are coupled to a shaft by means of a wobbler mechanism which converts the reciprocatory movement of the pistons to rotary movement of the shaft. The shaft is provided with an intermediate stiffener portion having two angularly disposed substantially elliptical base portions. A wobbler slug is coupled to the shaft stiffener so that a spider assembly moves about the shaft on the wobbler slug. The spider assembly is provided with arms which are coupled to pistons so that movement of the pistons forces a rotation of the wobbler slug coupled to the shaft stiffener to rotate the shaft. The engine block is capable of being extruded.

15 Claims, 7 Drawing Figures

INTERNAL COMBUSTION ENGINE

BACKGROUND OF THE INVENTION

This invention relates to prime movers in general, and more particularly to internal combustion engines having reciprocatory pistons which employ a wobbler mechanism which converts the reciprocatory movement of pistons into rotary movement of the shaft.

Many types of wobbler mechanisms have been disclosed which convert reciprocating movement to rotary movement, particularly in connection with internal combustion engines. See, for example, U.S. Pat. No. 2,636,392 (Sparmann, Apr. 28, 1953); U.S. Pat. No. 2,403,282 (Holmes, July 2, 1946); U.S. Pat. No. 1,826,325 (Paul, Oct. 6, 1931); U.S. Pat. No. 1,885,323 (Duryea, Nov. 1, 1932); U.S. Pat. No. 3,006,324 (Shaw, Oct. 31, 1961); etc. One of the disadvantages with some of these types of mechanisms is the fact that the pistons are connected to the swash plate or wobbler with connecting rods. In the configurations using swash plates or wobblers there is a tendency of the swash plate or wobbler to rotate with the shaft which is not a desirable consequence. To prevent this, these devices use various means to maintain the point of contact between the connecting rods and swash plate or wobbler from rotating, thereby adding to the complexity and expense. Another difficulty with the systems described is that the wobbler mechanism disclosed is substantially complex which tends to increase the cost of manufacture and maintenance. The use of a stiffener obviates the necessity of inboard bearings.

SUMMARY OF THE INVENTION

An internal combustion engine includes an engine block having at least one cylinder bore disposed therein and a shaft disposed in the engine block. A stiffener has a substantially higher stiffness modulus than the shaft and is attached thereto so than an interior position of the shaft will remain substantially rigid under bending loads. A wobbler slug is attached to the shaft stiffener and mounted at an angle to the shaft axis. A pair of pistons are slidably mounted in the engine block cylinder bore and are connected by spider assembly spider arms to the wobbler slugs so that actuation of the pistons in the cylinders will move the spider arms and spider assembly to force the wobbler slugs against the stiffener assembly to rotate, thereby rotating the shaft. A typical engine might have four pistons mounted in two cylinder bores on opposite sides of the shaft with the wobbler slugs mounted directly opposite to each other so that the engine is balanced and acoustically isolated. The engine is designed so that three extrusions can be connected to form an engine block for an engine with two cylinder bores and four pistons, greatly reducing the costs of producing the engine block. The wobbler slug has a generally spool shape and has the spider assembly with cone shaped bushings riding on the wobbler slug. The engine might typically be a two-stroke air cooled engine.

BRIEF DESCRIPTION OF THE DRAWINGS

Other objects, features and advantages of the present invention will be apparent from the written description and the drawings in which.

DESCRIPTION OF THE PREFERRED EMBODIMENT

Figure 1:
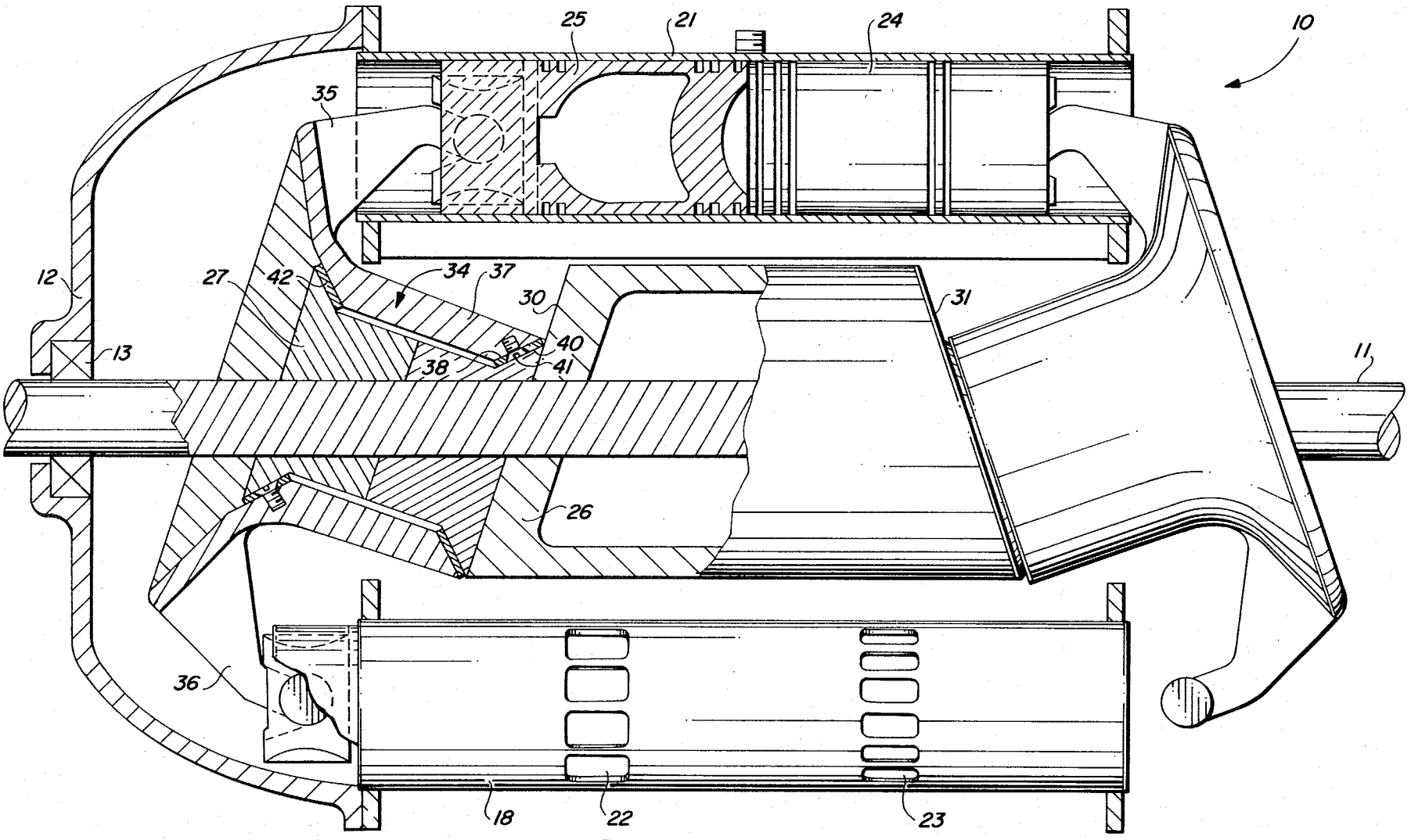
FIG. 1 is a cutaway sectional view of an engine in accordance with the present invention.
Figure 2:
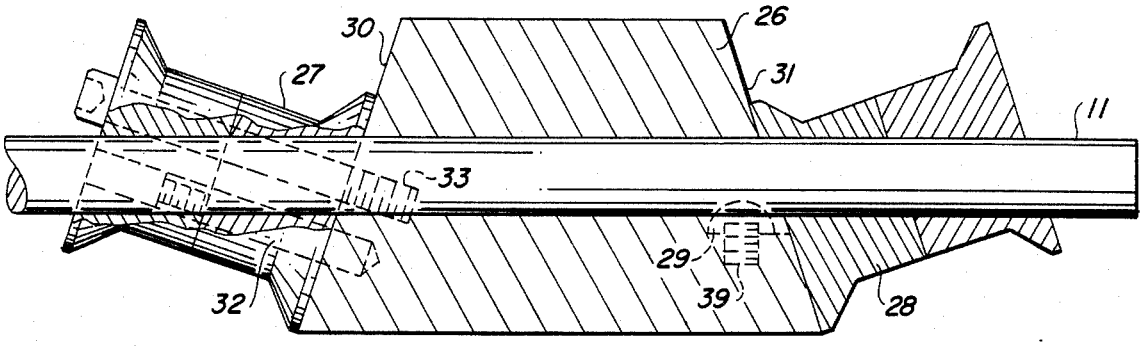
FIG. 2 is a side sectional view of the engine shaft having a stiffener and wobbler slugs mounted thereon.

Referring to the drawings and especially to FIG. 1, an internal combustion engine 10 is illustrated having a central shaft 11 supported in block end covers 12 having bearings 13 mounted therein. The end covers 12 are mounted to a three component engine block as more clearly shown in FIGS. 4 and 5 having air cooled cylinder module 14 on one side of the engine. A second cylinder module 15 is mounted on the other side and connected with block connecting members 16. The cylinder module 14 has air cooled cooling fins 17 and has a cylinder sleeve 18 mounted therein, while the cylinder module 15 has cooling fins 20 and a cylinder sleeve 21 mounted therein. The sleeves 18 and 21 have a plurality of openings 22 and 23 therein for receiving fuel air charged into each cylinder, as well as for ejecting the exhaust gas after the cylinders are fired. Each cylinder sleeve 18 and 21 has a pair of pistons 24 and 25 mounted therein which compress towards each other so that each firing of a cylinder will drive both pistons simultaneously. The cylinders are synchronized with a pair of matching cylinders on the opposite side of the engine block in the other cylinder sleeve. The shaft 11 has a stiffener 26 mounted thereon and supported against rotation with a key 29 as seen in FIG. 2 and held by set screw 39 in the shaft 11. The stiffener 26 has a substantially higher stiffness modulus than the shaft 11 so that the interior portion of the shaft will remain substantially rigid under bending loads applied by wobbler slugs 27. The wobbler slugs 27 and 28 are mounted in what appears to be identical angles in the same direction on the shaft 11 and in accordance with the angle surface 30, and angle surface 31 of the stiffener 26. However, they are driving pistons from opposite directions in the sleeves 18 and 21 so that they are working in an opposite direction to each other. The wobbler slug 27 is attached with threaded fasteners 32 and 33 as shown in FIG. 2 to the stiffener 26 to lock it in position at the angle as shown in the drawings, which angle is perpendicular to the angle of the surface 30 or 31 of the stiffener 26. The spider assembly 34 has spider arms 35 and 36 for attaching to the pistons 25 and has a base portion 37 shaped to fit the annular spool shape of the wobbler slug 27. The spider assembly 34 base portion has an annular or truncated cone surface 38 which has truncated cone bushing or bearings 40 held with set screws 41 for riding on the matching spool surface 42 of the wobbler slug 27. Pistons 24 and 25 are coupled to the shaft 11 through the spider assembly 34 and wobbler slug 27 and stiffener 26 to convert the reciprocatory movement of the pistons to rotary movement of the shaft 11.

As the pistons are fired in each cylinder 18 and 21 they apply pressure from opposite sides to the spider assemblies 34 and against the angled wobbler slugs 27 attached to the stiffeners 26 to force the stiffener 26 and shaft 27 to rotate. Stiffener 26 not only adds rigidity to the shaft 11 so that it can resist the bending loads applied to it by the combustion forces through the spider assembly 34, but eliminates some of the bearings required to support the shaft and eliminates bearing loads which might otherwise be directly applied against the shaft. Having the cylinders mounted on either side of the shaft 11, and firing in an opposed fashion allows the engine to maintain balance and to acoustically isolate shock loads emanating from the high rate of pressure rise in the combustion chambers.

The overall engine is thus lighter because of the engine block, which can be advantageously extruded, for the resulting horse power created by the engine.

Figure 3:
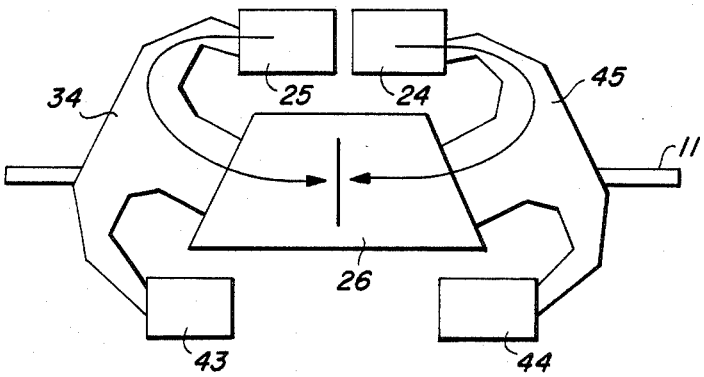
FIG. 3 is a diagrammatic view of the engine showing the balancing characteristics of the components.

The balancing of the engine is illustrated in FIG. 3 in which the pistons 24 and 25 are shown as they apply forces against a stiffener 26 mounted to the shaft 11 while a second set of pistons 43 and 44 are mounted to the other side of the spider assemblies 34 and 45 and would reach their maximum compression at the opposite end of the cycle as shown in FIG. 3. Ignition of the charge between the pistons 24 and 25 will, of course, take place near or adjacent top dead center or where the pistons are at their closest point for maximum compression. In the case of a diesel engine, ignition also occurs near top dead center of the pistons such as shown in pistons 24 and 25 in the diagrammatic view of FIG. 3.

FIG. 2 more clearly shows the stiffener member 26 having the wobbler slugs 27 and 28 mounted thereon adjacent the surfaces 30 and 31. The wobbler slugs 27 and 28, of course, are mounted to have an elongated axis perpendicular to the angles 30 and 31, and are held to the stiffener with the threaded fasteners 32 and 33 and ride over the shaft 11. Thus, the greater portion of the forces applied to the wobbler slugs 27 and 28 is applied against the ends of the stiffener 26 to reduce the bend and other forces applied directly to the shaft 11. Each wobbler slug 27 and 28 consists of two identical halves securely held to the end stiffener with bolts and dowel pins.

Figure 4:
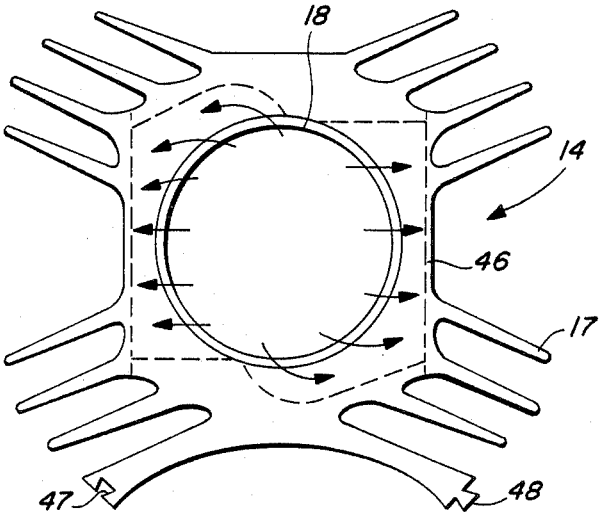
FIG. 4 is a sectional view of one cylinder portion of the engine in accordance with FIG. 1.
Figure 5:
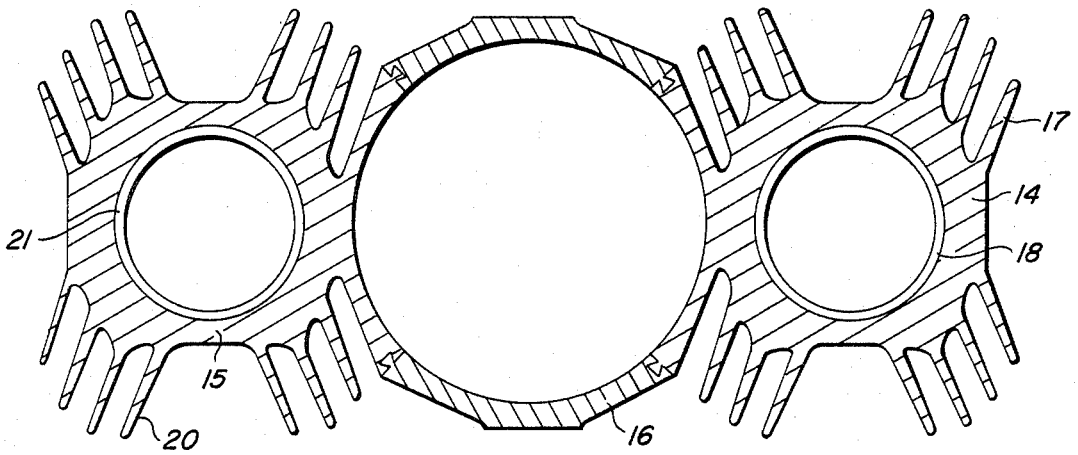
FIG. 5 is a sectional view of a engine block in accordance with FIG. 1.

FIG. 4 shows one air cooled cylinder module 14 having an aluminum body 46 cooling fins 17 and a cast iron or metal sleeve 18 press fitted therein and includes a dovetail groove 47 and a dovetail edge 48 for connecting up with the block connecting portion 16. This allows each of the cylinder modules 14 and 15 as well as the block portions 16 to be extruded in an air cooled engine to reduce the cost of the block substantially. Such extruded portions would be extruded aluminum alloy with steel sleeves 18 and 21 mounted therein and might have cast block ends 12 as shown in FIG. 1 with the bearings 13 to hold the shaft 11.

Figure 6:
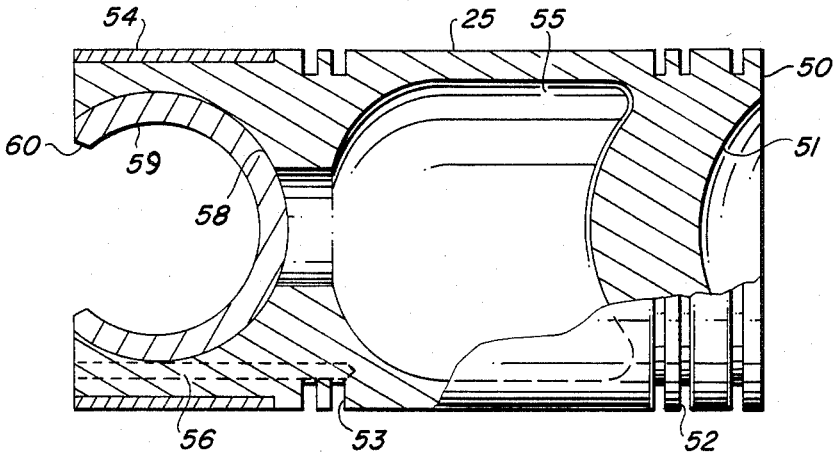
FIG. 6 is a sectional view of a piston used in the engine of FIGS. 1 through 5.
Figure 7:
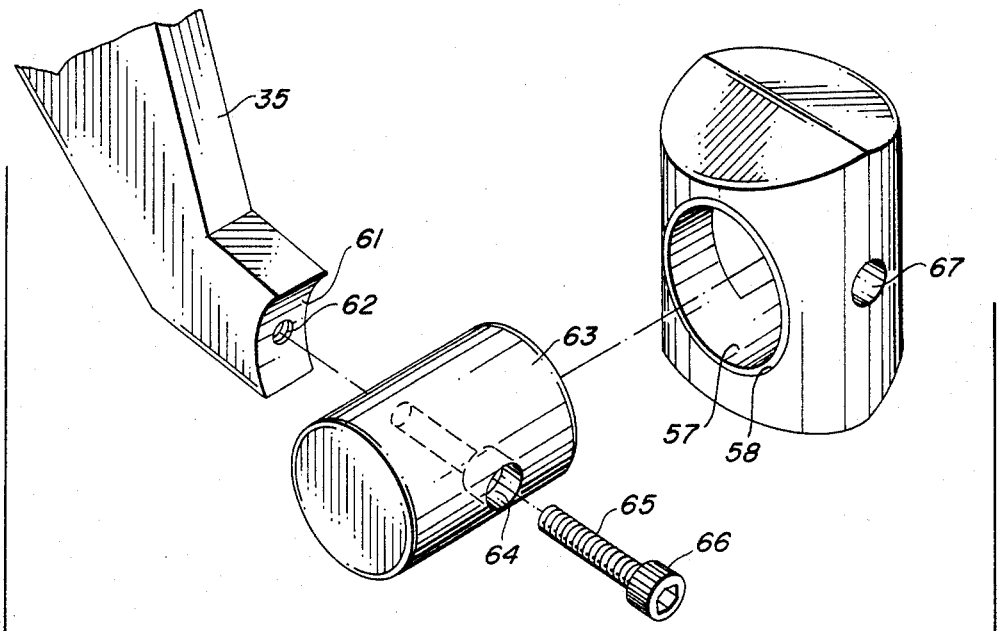
FIG. 7 is an exploded view of a piston connection for the spider assembly.

Turning to FIGS. 6 and 7, piston 25 is shown in FIG. 6 with a connecting assembly shown in FIG. 7. The piston 25 has a face 50 which may have a cup surface 51 formed therein along with a plurality of annular piston ring grooves 52 formed around the top edge thereof and a pair of oil ring grooves 53 around the lower portion thereof. In addition, oil shields 54 may be used to limit the oil spray from the center block assembly while lubricating the cylinder sleeves. Cylinder 25 may have a hollow center portion 56 and may have a series of drain holes 56 to drain the oil scraped off by the oil ring 53. Piston 25 is connected to the spider assemblies 34 as shown in FIG. 7. Piston 25 has a cylinder bushing 59 mounted in an arcuate cylindrical portion 58 having the opening 60 from the rear of the piston 25. The spider arm 35 from the spider assembly 34 has an arcuate surface 61 on the end thereof and an internally threaded bore 62 therein. A piston holding pin 63 has a bore 64 therethrough for attaching with a countersunk screw 65 through the allen wrench access opening 66 of joint mamber 58. Spider arm 35 is connected to the piston 25 by sliding the cylindrical pin 63 inside the joint member 58 and then locking the end of the spider arm 35 with the screw 65 through the aperture 67 into the threaded opening 62. The opening 60 is too small for the joint member 58 to be removed transverse to its' longitudinal axis but the threaded fastener 65 can be locked through the access opening 67 in the joint member 58. This allows the spider arm 35 to rotate with the pin 63 in the opening 57 and with the rotation of joint member 58 as the piston pushes the spider assembly arm 35 in one direction and as the piston 25 compresses in the opposite direction. Access hole 67 through the joint member 58 allows the pin 63 and bushing 59 to be slid from one end into the opening 57 of the joint member 58 and the joint member then inserted into the sleeve 59. The pistons are slid into the sleeves, while the wobbler slug 27 is being slid onto the shaft, and the wobbler shaft can then be locked to the stiffener 26 with the pistons and spider assembly in place.

It should be clear at this point that a wobbler internal combustion engine has been shown which simplifies prior wobbler engine designs while simplifying the number of components used in an internal combustion engine and allowing the use of an extruded aluminum block for the engine. It should also be clear that the present engine is designed to acoustically balance the operation of the cylinders, spider assemblies, acting against the wobbler slugs and shaft stiffener to reduce vibration and noise in a balanced arrangement. However, the present invention is not to be construed as limited to the forms shown which are to be considered illustrative rather than restrictive.

I claim:

1. An internal combustion engine comprising:

an engine block having a plurality of extruded aluminum alloy modules. each module having a cylinder bore disposed therein;

a shaft defining an axis of rotation and disposed in said engine block;

a unitary stiffener having a substantially higher stiffness modulus than the shaft, coaxially attached to the shaft so that an interior portion of the shaft will remain substantially rigid under bending loads;

a wobbler slug attached to said shaft stiffener and mounted at an angle to said shaft;

a pair of pistons slidably mounted in said engine block cylinder bore; and a spider arm assembly having at least one single piece spider arm connected to at least one portion, said spider arm assembly being operatively coupled to said wobbler slug; whereby movement of said piston will move said spider arm assembly against said wobbler slug to rotate said shaft in a wobbler engine.

2. An internal combustion engine in accordance with claim 1 in which said engine block has a pair of cylinder modules thereon, each having a pair of pistons slidably mounted therein.

3. An internal combustion engine in accordance with claim 2 in which said pair of extruded cylinder modules are connected with extruded block members for forming an extruded engine block.

4. An internal combustion engine in accordance with claim 3 in which said engine block has a pair of block ends on each end of said extruded block having bearings mounted therein for supporting said shaft.

5. An internal combustion engine in accordance with claim 4 in which said stiffener is supported on said shaft with a key connecting said shaft and stiffener.

6. An internal combustion engine in accordance with claim 5 in which said wobbler slugs are attached to said stiffeners with at least one threaded fastener member.

7. An internal combustion engine in accordance with claim 6 in which said wobbler slug has a general spool shape mounted at an angle to said shaft and supporting said spider arm assembly therein.

8. An internal combustion engine in accordance with claim 7 in which said spider assembly has truncated cone shaped bearings mounted therein for riding on spool edges of said wobbler slug.

9. An internal combustion engine in accordance with claim 8 in which said engine block extruded aluminum cylinder module has a steel sleeve mounted therein.

10. An internal combustion engine in accordance with claim 9 in which each said piston has a plurality of annular piston ring grooves therein and a plurality of annular oil grooves for collecting oil in said cylinder and a plurality of bore connecting one end of said piston to said annular oil grooves.

11. An internal combustion engine in accordance with claim 10 in which said piston has an oil shield therearound to limit oil spray from the engine block.

12. An internal combustion engine in accordance with claim 11 in which each said piston is connected to its spider arm assembly with a cylindrical member fitting in a cylindrical opening in one end of said piston and having an opening therethrough.

13. An internal combustion engine in accordance with claim 12 in which each said piston is connected to its spider arm assembly spider arm with a set screw attaching said cylindrical member in said cylindrical bore in said piston to one end of one spider arm of said spider arm assembly.

14. An internal combustion engine in accordance with claim 13 in which each said piston cylindrical opening for holding a cylindrical member has a bushing mounted therein to allow rotation of said cylindrical member attached to an end of said spider arm.

15. An internal combustion engine in accordance with claim 14 in which said spider arm assemblies have spider arms formed in a generally U-shape cross section to direct forces from said pistons through said spider arm assemblies to said wobbler slugs in a predetermined stress pattern in said spider arm assembly.

* * * * *